US010595577B1

(12) United States Patent
Lewis

(10) Patent No.: US 10,595,577 B1
(45) Date of Patent: Mar. 24, 2020

(54) LEWIS HELMET

(71) Applicant: Terry Leonard Lewis, Jacksonville, FL (US)

(72) Inventor: Terry Leonard Lewis, Jacksonville, FL (US)

(73) Assignee: Terry Leonard Lewis, Jacksonville, FL (US)

( * ) Notice: Subject to any disclaimer, the term of this patent is extended or adjusted under 35 U.S.C. 154(b) by 225 days.

(21) Appl. No.: 15/704,946

(22) Filed: Sep. 14, 2017

Related U.S. Application Data

(60) Provisional application No. 62/496,379, filed on Oct. 17, 2016.

(51) Int. Cl.

| | |
|---|---|
| ***A42B 3/00*** | (2006.01) |
| ***A42B 3/06*** | (2006.01) |
| ***A42B 3/32*** | (2006.01) |
| ***A63B 71/10*** | (2006.01) |

(52) U.S. Cl.
CPC ..... *A42B 3/064* (2013.01); *A42B 3/324* (2013.01); *A63B 71/10* (2013.01); *A63B 2243/007* (2013.01)

(58) Field of Classification Search
CPC ..... A42B 3/064; A42B 3/324; A63B 71/10; A63B 2243/007
See application file for complete search history.

(56) References Cited

U.S. PATENT DOCUMENTS

| | | | | |
|---|---|---|---|---|
| 6,378,140 | B1 * | 4/2002 | Abraham | A42B 3/064 2/411 |
| 9,388,873 | B1 * | 7/2016 | Phipps | B60R 19/28 |
| 9,693,594 | B1 * | 7/2017 | Castro | A42B 1/08 |
| 9,795,178 | B2 * | 10/2017 | Suddaby | A42B 3/124 |
| 2012/0047635 | A1 * | 3/2012 | Finiel | A42B 3/125 2/414 |
| 2013/0061371 | A1 * | 3/2013 | Phipps | A42B 3/064 2/411 |
| 2013/0185837 | A1 * | 7/2013 | Phipps | A42B 3/12 2/2.5 |
| 2014/0215694 | A1 * | 8/2014 | Grice | A42B 3/064 2/411 |
| 2015/0143617 | A1 * | 5/2015 | Suddaby | A42B 3/064 2/414 |

(Continued)

*Primary Examiner* — Amy R Weisberg

(57) ABSTRACT

A protective football helmet is provided having a two-piece mold shell diminution shell system.
The helmet is comprised of a nine-piece part outer shell, a solid rim outer shell to deflect direct impact from the nine piece part outer shell, an inner liner helmet, compression springs as shocks, and a spin dial to control and restrict the movement of the compression springs and nine piece part outer shell. The nine piece part is a special designed helmet to absorb impact on contact from the crown of the helmet, all four sides and all angles in between to protect the players' head from direct contact at any angle. The outer shell diminution system is piece parted to absorb the impact energy individually by the outer shell protection. Each outer shell piece parted section takes on the impact of energy with an oval shape to deflect and transfer contact impact energy from one piece part to another, thereby dispersing the energy throughout the outer shell of the helmet.

1 Claim, 20 Drawing Sheets

(56) References Cited

U.S. PATENT DOCUMENTS

| | | | | |
|---|---|---|---|---|
| 2015/0208751 | A1* | 7/2015 | Day | A42B 3/064 2/414 |
| 2016/0029730 | A1* | 2/2016 | Day | F16F 3/04 2/412 |
| 2017/0065018 | A1* | 3/2017 | Lindsay | A42B 3/067 |
| 2017/0112220 | A1* | 4/2017 | Suddaby | A42B 3/064 |
| 2017/0143054 | A1* | 5/2017 | Yoon | A41D 13/015 |
| 2018/0228239 | A1* | 8/2018 | Day | A42B 3/064 |

* cited by examiner

LEWIS HELMET

BACKGROUND OF THE INVENTION

Helmets for contact sports football, etc. and other helmet used activities such as biking, motorcycle riding, NASCAR driving typically includes a hard outer and inner pad assembly along with to an interior surface of the shell. Face guard protection and a chin protector or strap that can be removed from the head gear if necessary. Traditional sports helmets may include different designs corrugations formed in the helmet shell with numerous openings in the shell. These openings can include openings for attachment accessories such as faceguard, chin strap and internal padding system. The opening can also include apertures to improve ventilation while the helmet is being worn.

In traditional helmets shapes, sizes and locations of these openings are designed to minimize any structural weakness in the shell that may result from removing material from the shell to form these openings. The various ribs, ridges and corrugations found in conventional sports helmets often function to increase shell stiffness, especially in the region of the shell that includes these features. The performance of the helmet is complicated by the inclusion of the combination of multiple shell opening and ribs, ridges and or corrugations.

Features and advantages of the invention will be apparent to those skilled in the art upon review of the following detailed descriptions and accompanying drawings.

BRIEF SUMMARY OF THE INVENTION

This invention purpose is to describe a protective football helmet. Including a two piece mold shell and a diminution impact system. Purposely engineered to a piece parted helmet on impact disperses the linear force series of impact received by the helmet. The impact diminution system includes a contact spring absorption system formed between the outer and the inner shell that is connected to the inner shell. An inner pad/bosses is connected to the inner shell.

DRAWINGS OF HELMET LIST OF PARTS INCLUDED IS AN EXPLOSIVE VIEW OF THE PRODUCT

Figure 1:
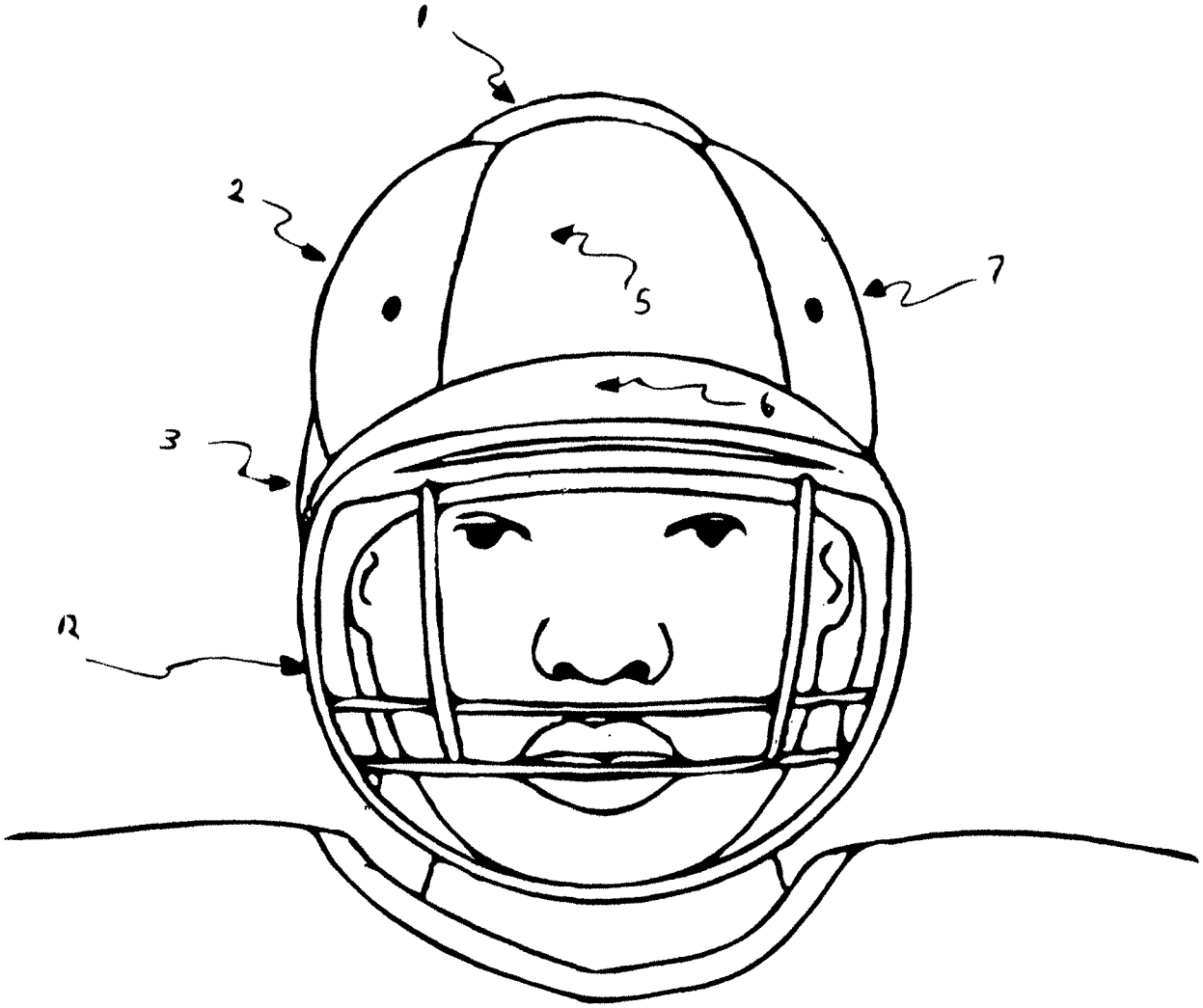
FIG. 1 Is a front view with outer shell attached to helmet, also with face mask attached to outer shell of helmet with an example image of a person modeling the helmet.
Figure 2:
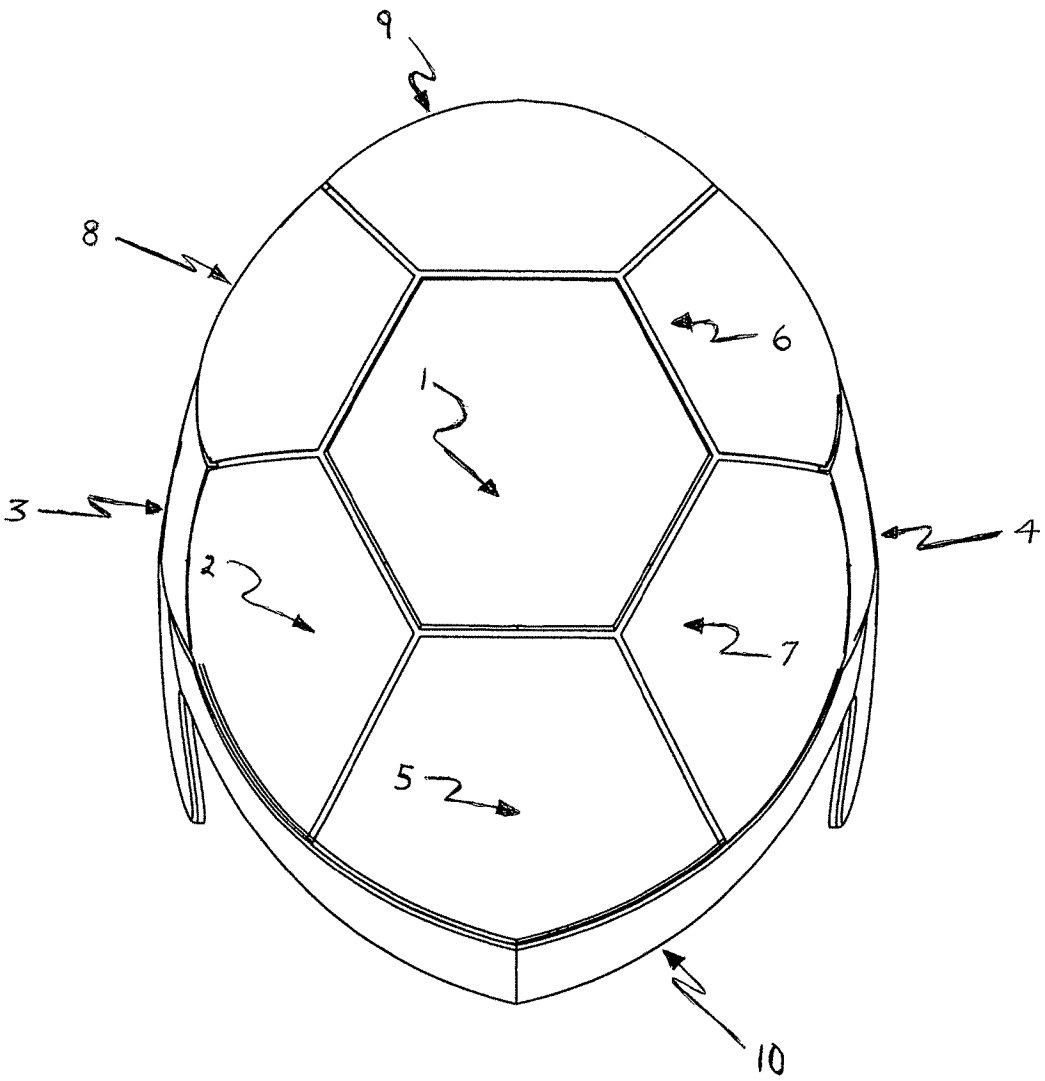
FIG. 2 Is a top view with the outer shell pieces attached to helmet.
Figure 3:
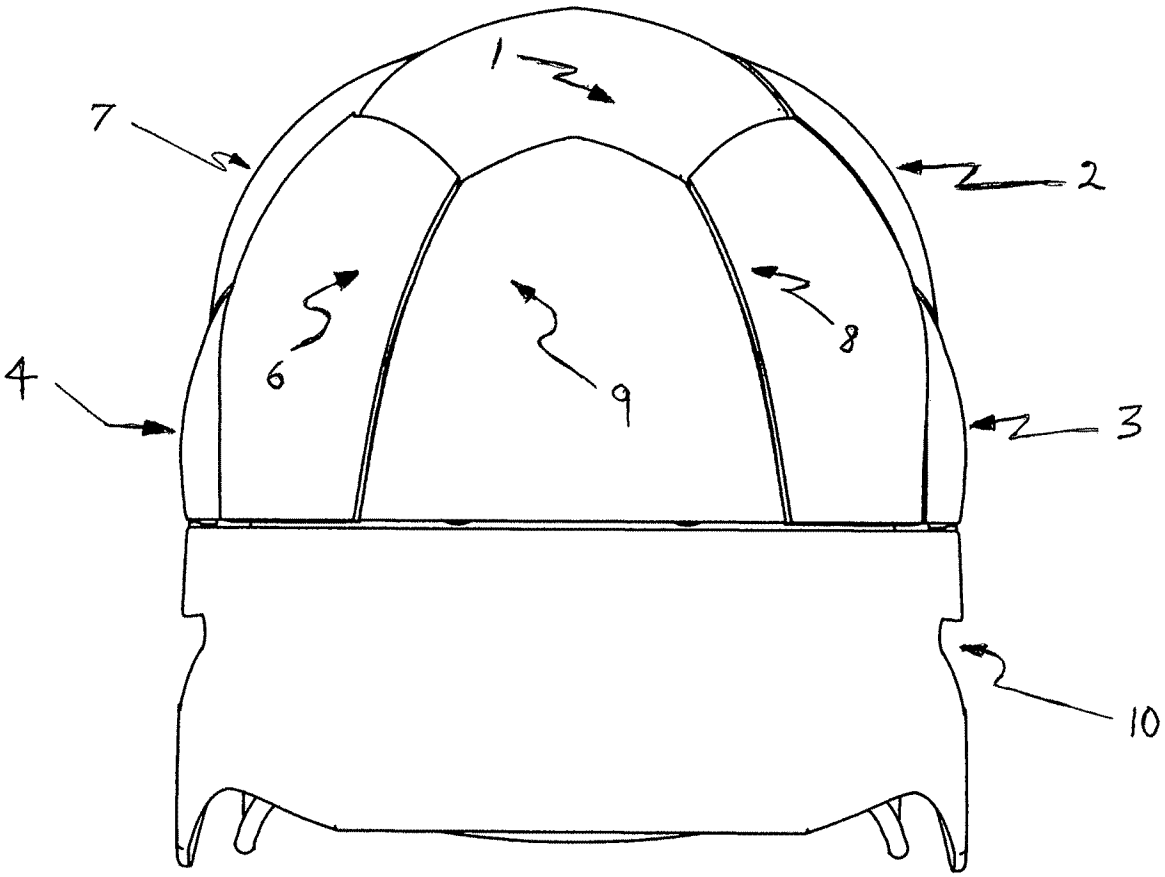
FIG. 3 Is a back view with the outer shell pieces attached to helmet, also showing an attached solid rim of the outer shell of the helmet.
Figure 4:
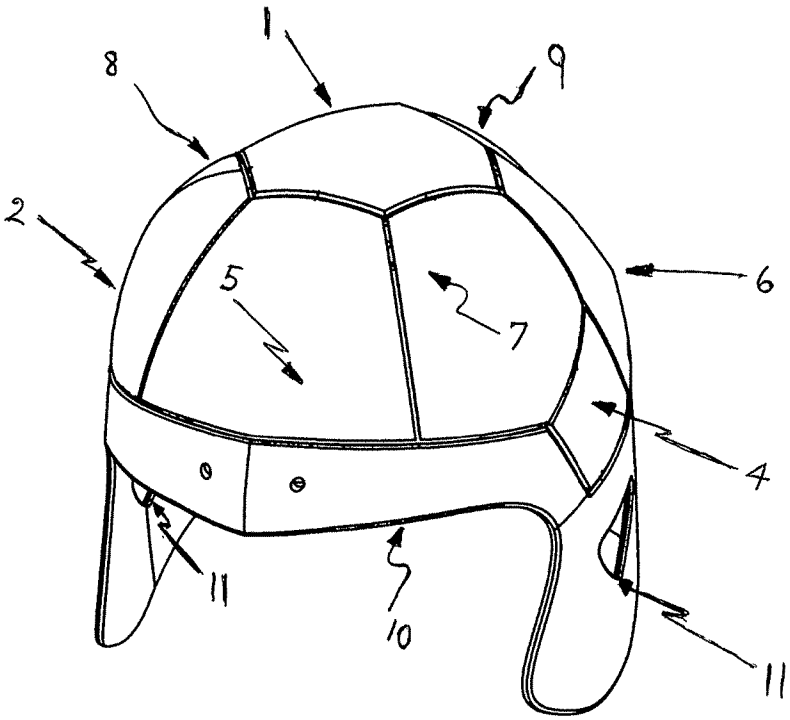
FIG. 4 Is an Iso-view with outer shell pieces attached to helmet, also showing an attached solid rim to the helmet.

FIG. 1: Front View:
01: Outer shell original shape piece part
02: Outer shell original shape piece part
03: Outer shell original shape piece part
04: Outer shell original shape piece part
05: Outer shell original shape piece part
06: Outer shell original shape piece part
07: Outer shell original shape piece part
08: Outer shell original shape piece part
09: Outer shell original shape piece part FIG. 2: Top View:
01: Outer shell original shape piece part
02: Outer shell original shape piece part
03: Outer shell original shape piece part
04: Outer shell original' shape piece part
05: Outer shell original shape piece part
06: Outer shell original shape piece part
07: Outer shell original shape piece part
08: Outer shell original shape piece part
09: Outer shell original shape piece part
10: Solid rim outer shell FIG. 3: Back View:
01: Outer shell original shape piece part
02: Outer shell original shape piece part
03: Outer shell original shape piece part
04: Outer shell original shape piece part
05: Outer shell original shape piece part
06: Outer shell original shape piece part
07: Outer shell original shape piece part
08: Outer shell original shape piece part
09: Outer shell original shape piece part
10: Solid rim outer shell FIG. 4: Iso View:
01: Outer shell original shape piece part
02: Outer shell original shape piece part
03: Outer shell original shape piece part
04: Outer shell original shape piece part
05: Outer shell original shape piece part
06: Outer shell original shape piece part
07: Outer shell original shape piece part
08: Outer shell original shape piece part

Figure 5:
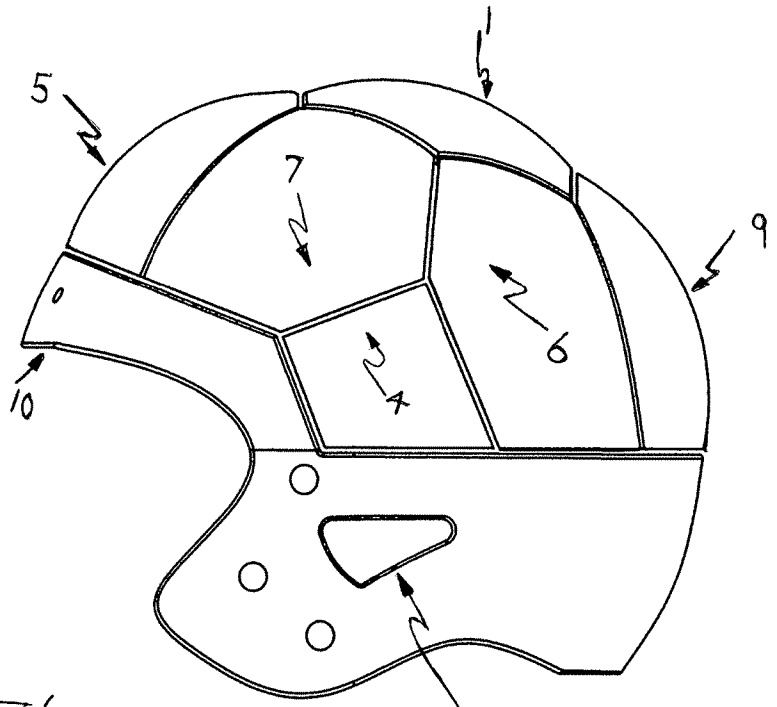
FIG. 5 Is a left side view with outer shell pieces attached to helmet, also showing an attached solid rim FIG. 6 Is a bottom view of the completed helmet, with facemask and pads inside.
Figure 6:
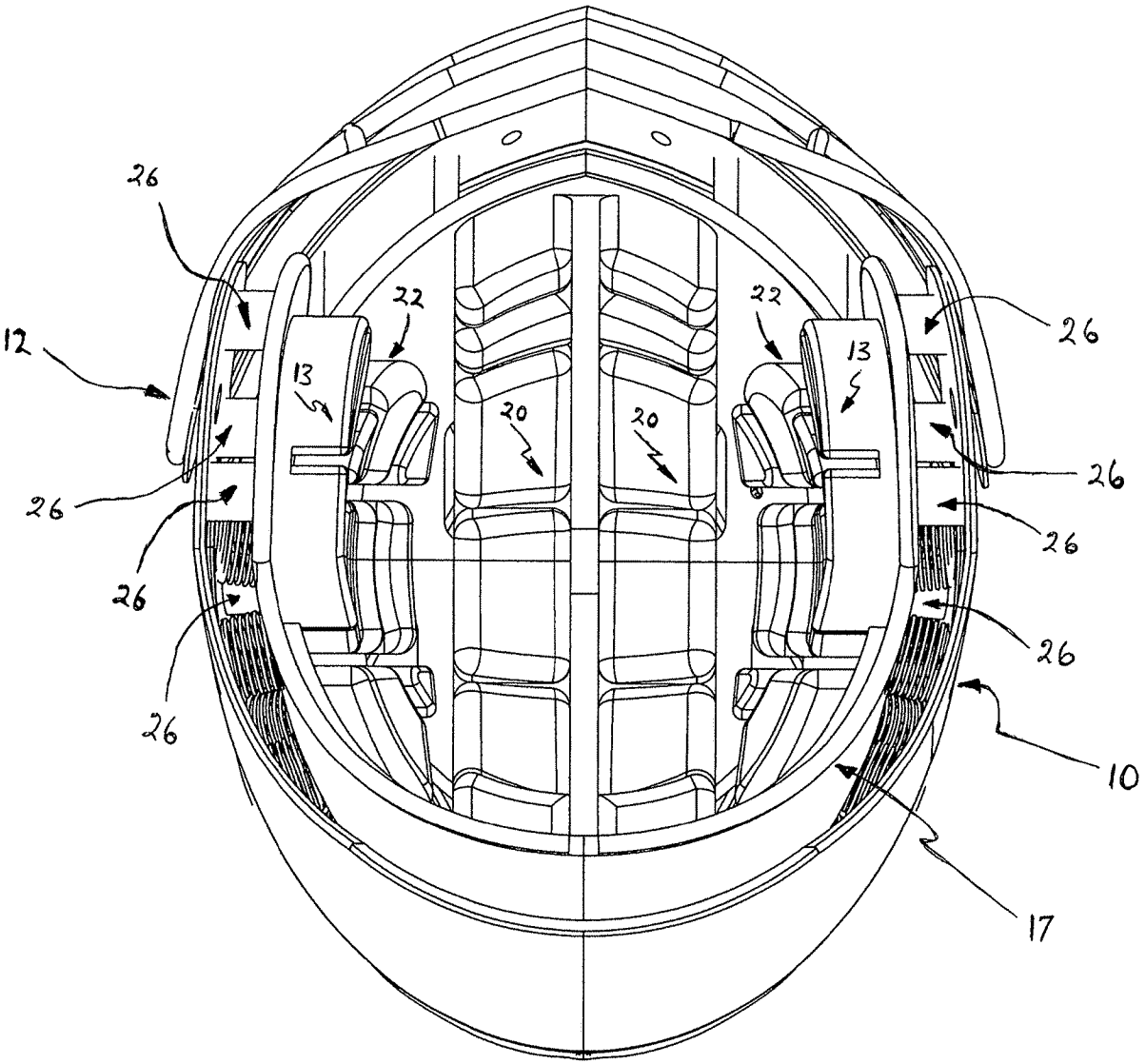
Figure 7:
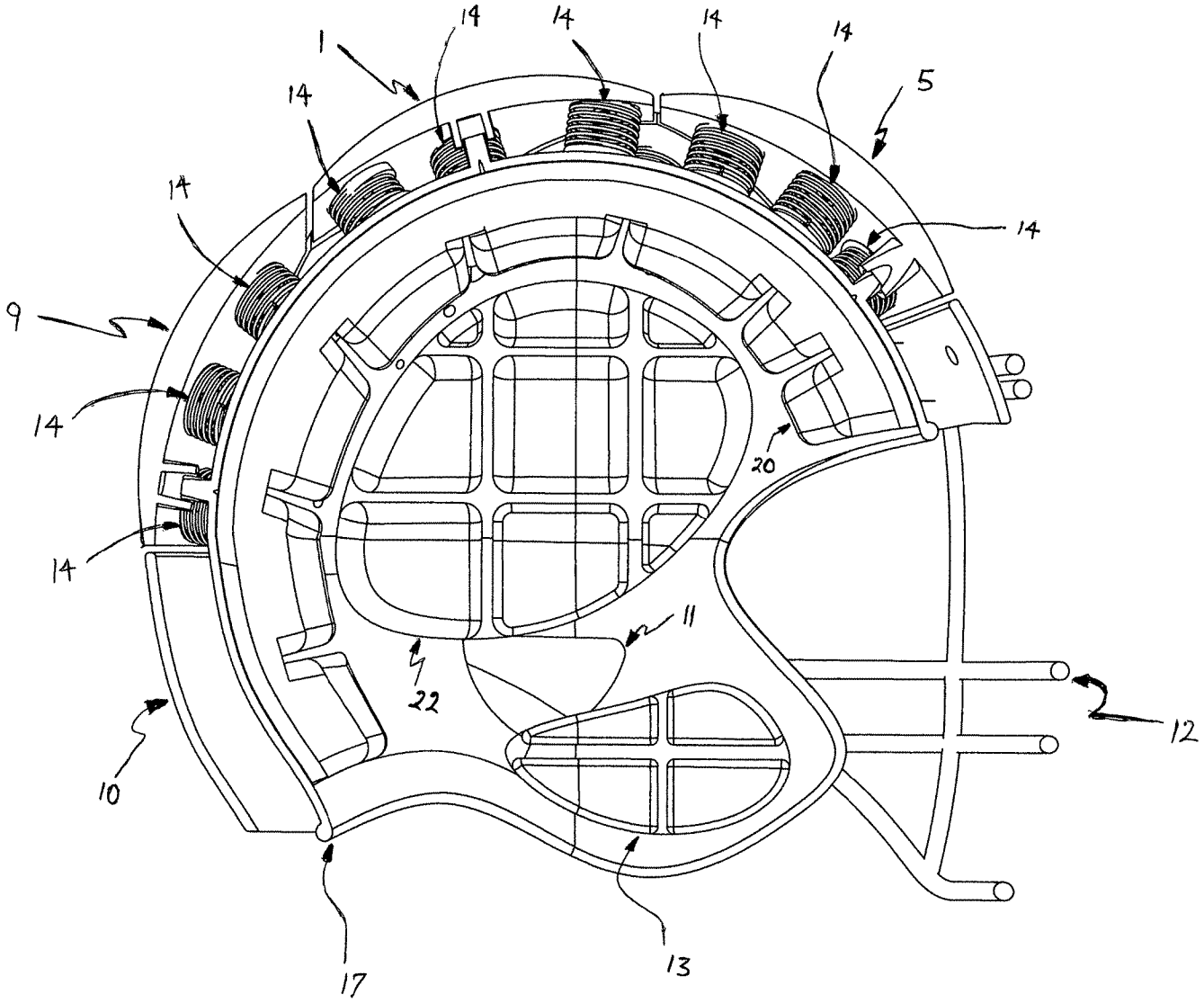
FIG. 7 Is a right side half view of the helmet showing all piece parts inside helmet.
Figure 8:
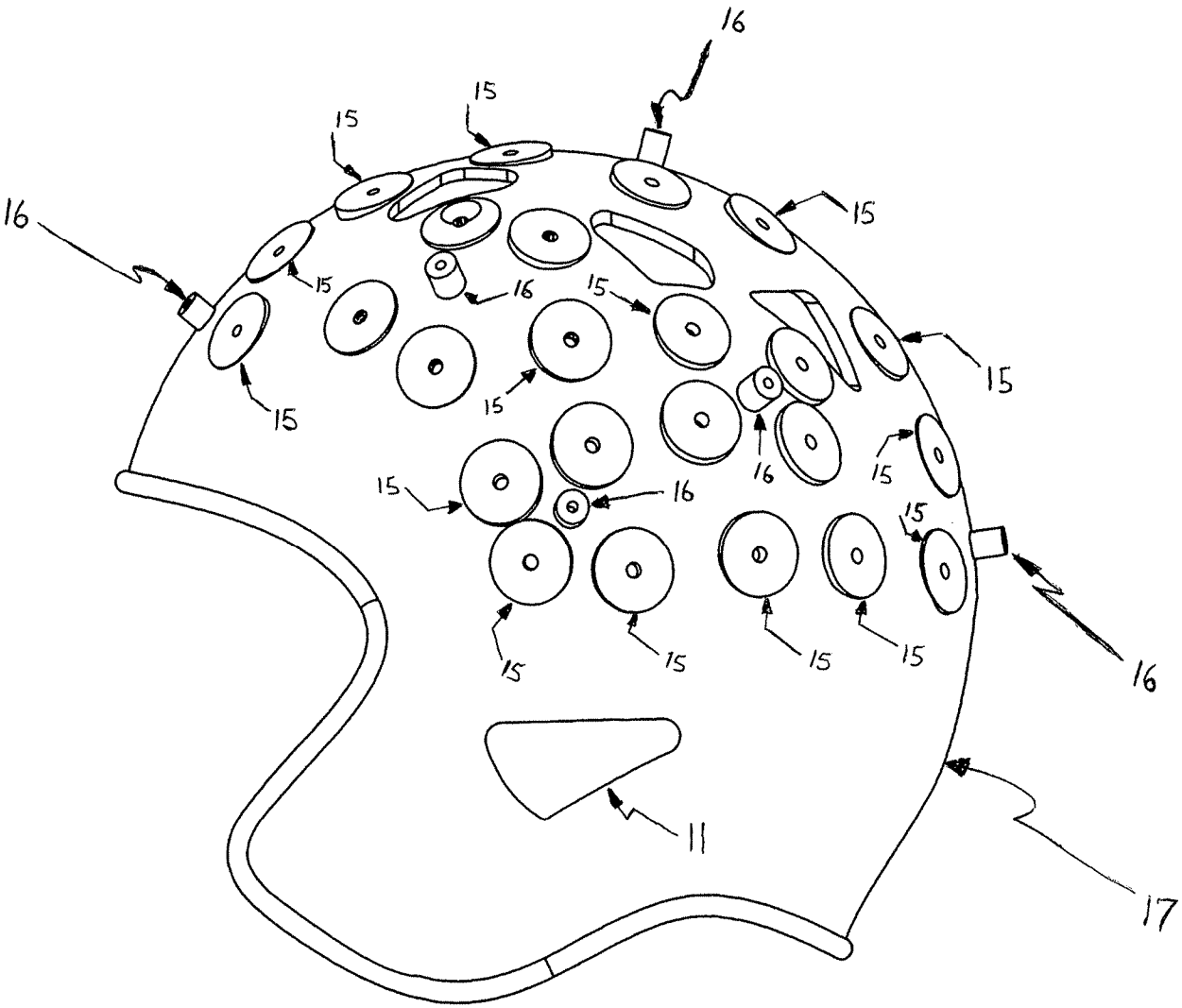
FIG. 8 Is a left side view of inner liner helmet with bosses and stud guides attached to helmet.
Figure 9:
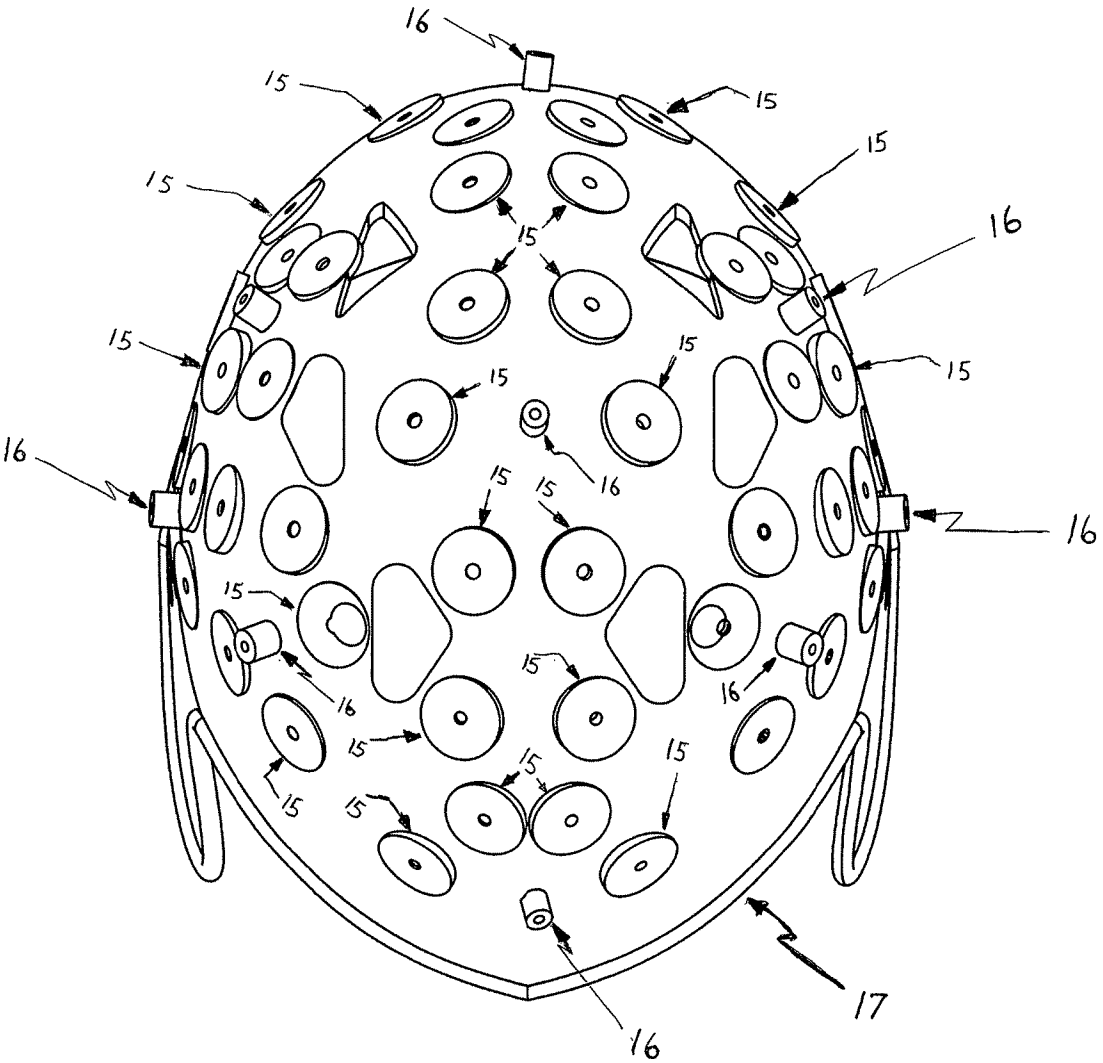
FIG. 9 Is a top view of the inner liner helmet with bosses and stud guides attached to helmet.
Figure 10:
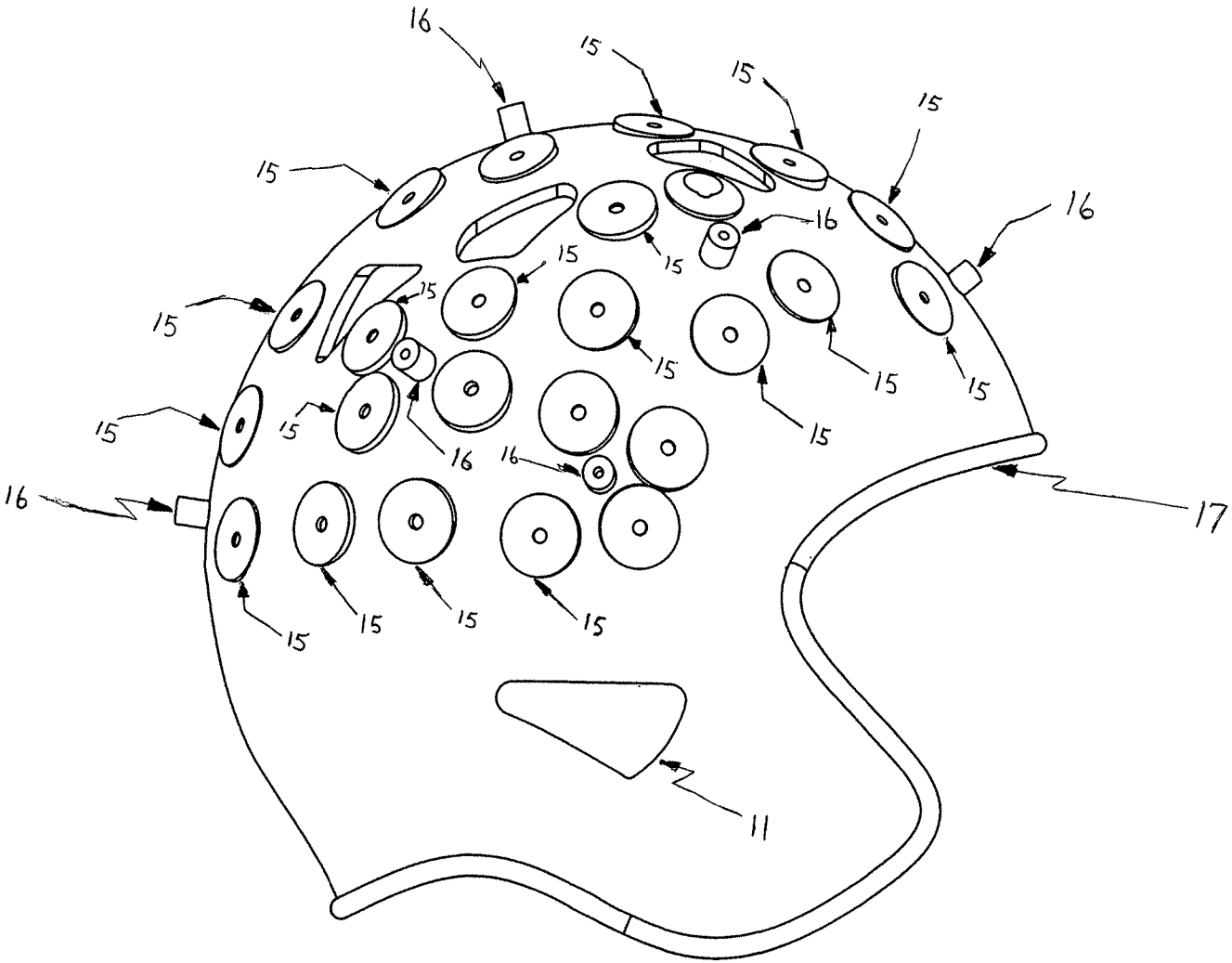
FIG. 10 Is a right side view of the inner helmet with bosses and stud guides attached to helmet.
Figure 11:
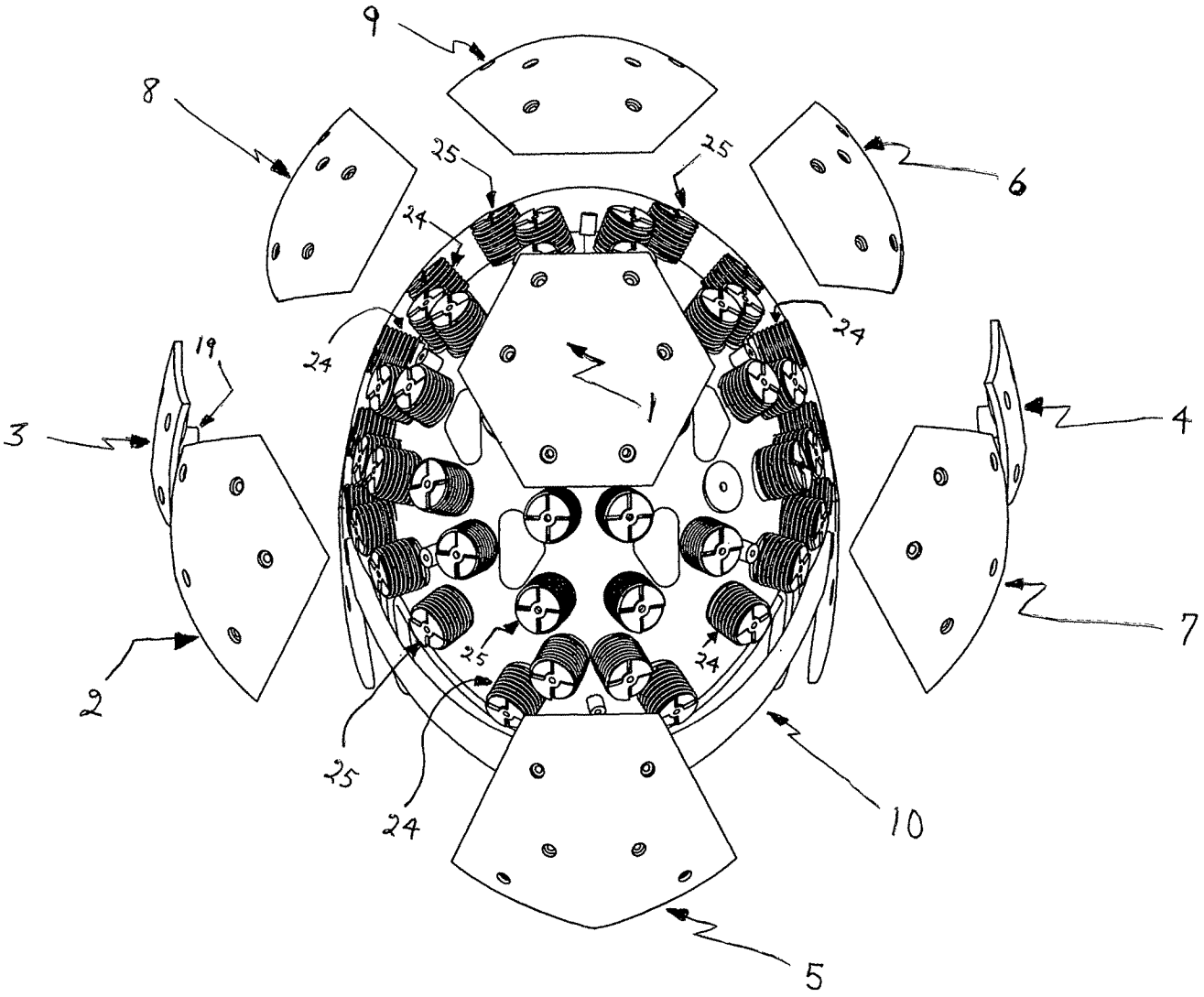
FIG. 11 Is an exploded top view of outer shell piece parts with dials, springs, inner liner helmet and solid rim outer shell attached to inner liner helmet.
Figure 12:
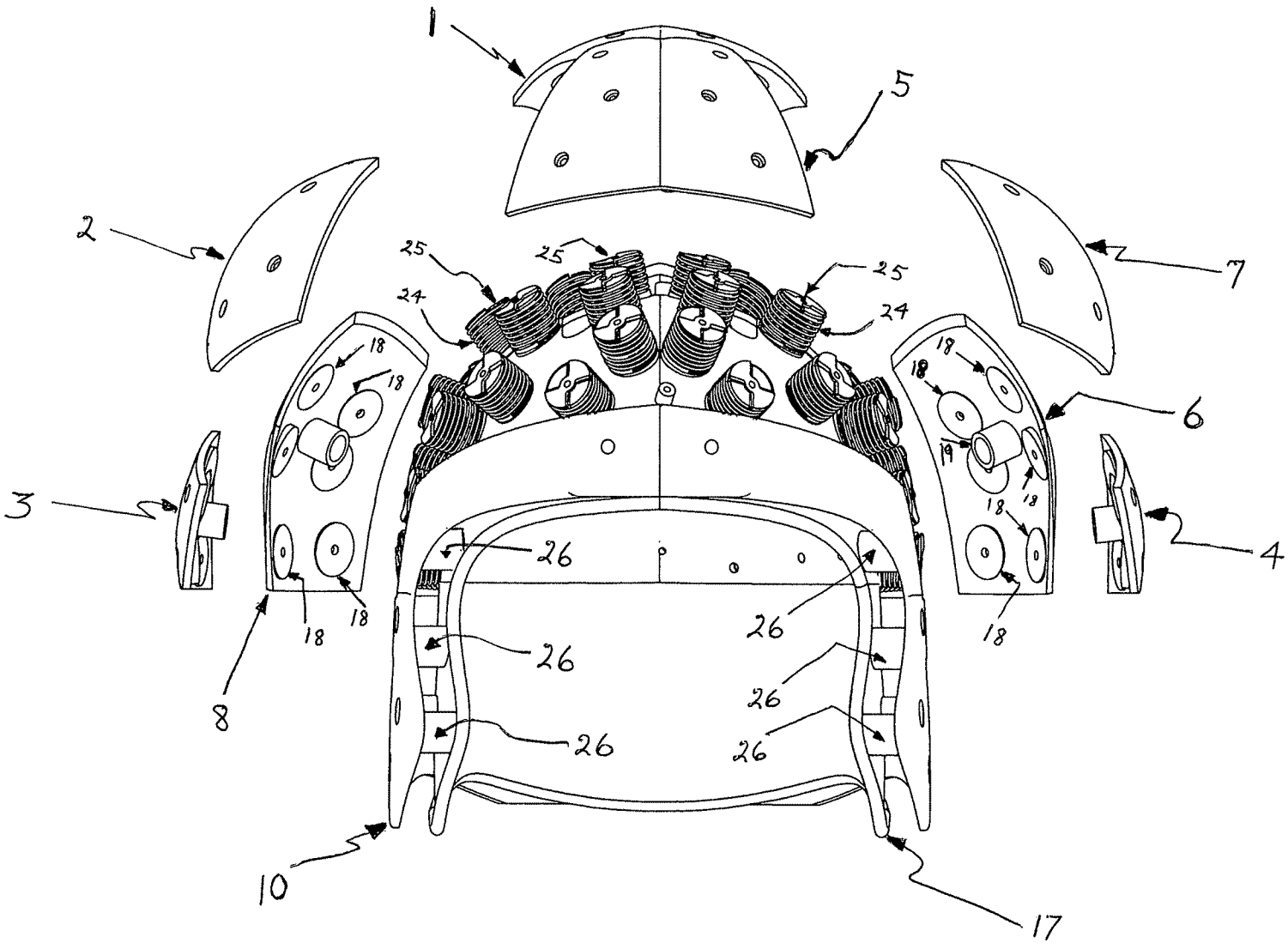
FIG. 12 Is a front exploded view of outer shell piece parts with dials, springs, inner liner helmet and solid rim outer shell attached to inner liner helmet.
Figure 13:
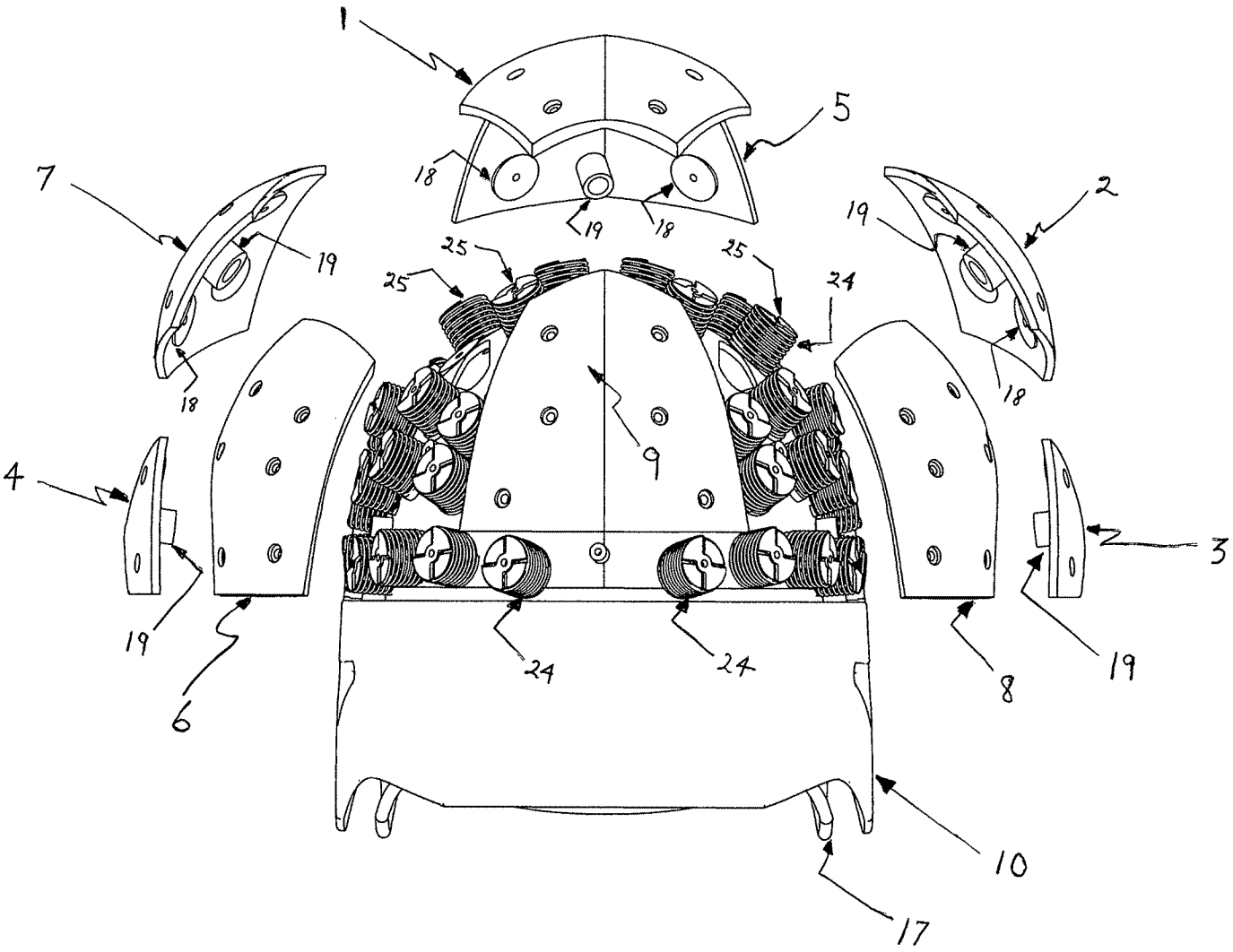
FIG. 13 Is a back exploded view of outer shell piece parts with dials, springs, inner liner helmet and solid rim outer shell attached to inner liner helmet.
Figure 14:
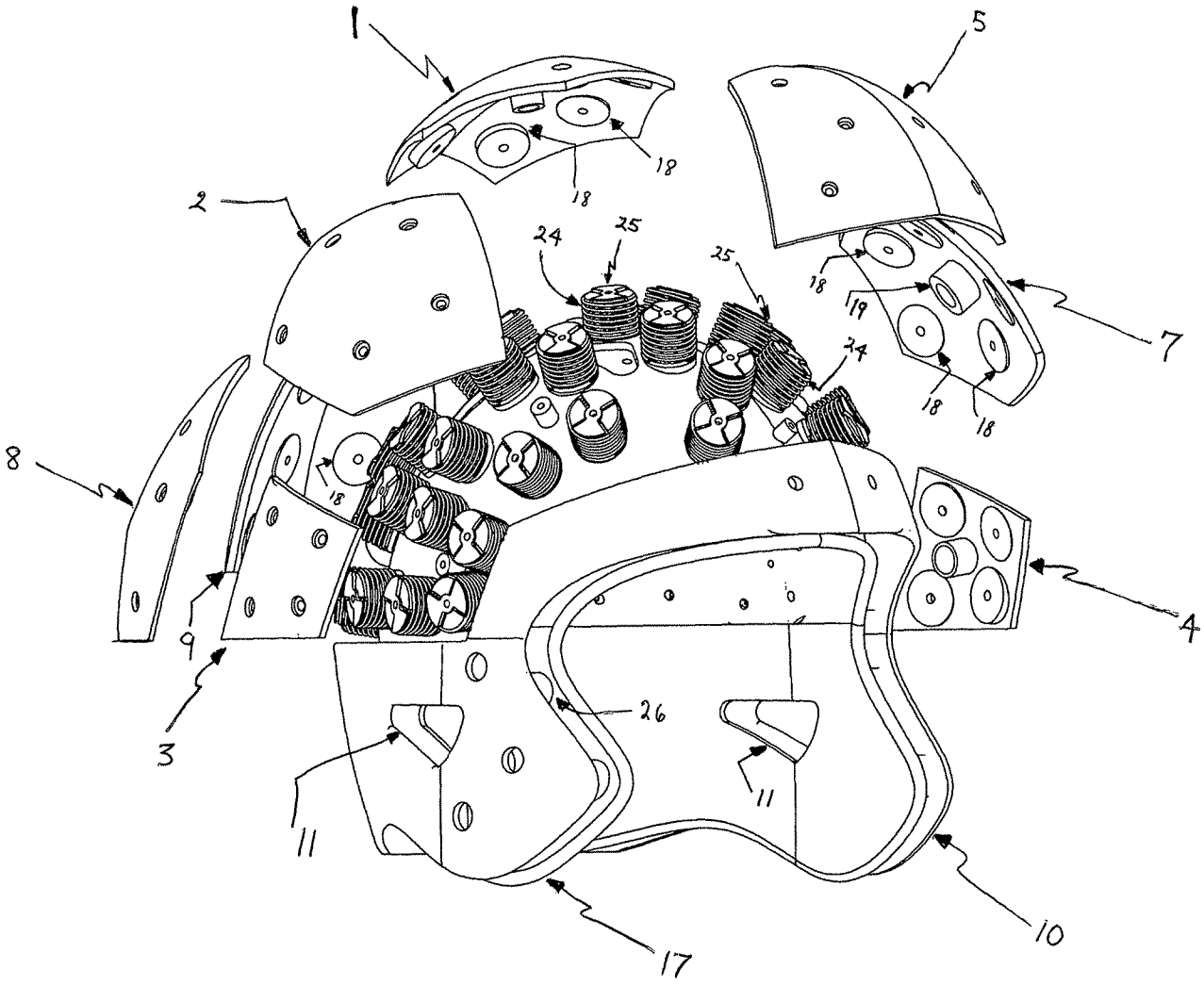
FIG. 14 Is a right side exploded view of outer shell piece parts with dials, springs, inner liner helmet and solid rim outer shell attached to inner liner helmet.

09: Outer shell original shape piece part
10: Solid rim outer shell
11: Solid rim outer shell ear hole
FIG. 5: Left Side View:
03: Outer shell original shape piece part
04: Outer shell original shape piece part
05: Outer shell original shape piece part
06: Outer helmet rim solid shell
07: Outer helmet rim solid shield
10: Solid rim outer shell
11: Outer shell ear hole
FIG. 6: Bottom View:
10: Solid rim outer shell
12: Helmet face mask
17: Inner liner helmet solid shell
20: Inner liner helmet head pads
21: Inner liner helmet ear pads
22: Inner helmet left side and right side head pads
26. Connecting support to inner and outer shell solid rim attached together
FIG. 7: Right Side Half View of Helmet showing all piece parts inside helmet
01: Outer shell original shape piece part
05: Outer shell original shape piece part
09: Outer shell original shape piece part
11: Outer shell ear hole
12: Half a helmet face mask
13: Ear Pads
14: Dial and springs
20: Inner liner helmet head pads
22: Inner helmet left side and right side head pads
FIG. 8: Left Side View: of inner liner helmet with bosses and stud guides attached to helmet
11: Outer shell ear hole
15: Inner liner helmet bosses
16: Stud guides (male)
17: Inner liner helmet solid shell
FIG. 9: Top View: of the inner liner helmet with bosses and stud guides attached to helmet
15: Inner liner helmet bosses
16: Stud guides
17: Inner liner helmet solid shell
FIG. 10: Right Side View: of the inner liner helmet with bosses and stud guides attached to helmet
15: Inner liner helmet bosses
16: Stud guides
17: Inner liner helmet solid shell
FIG. 11: Exploded View: of outer shell piece, parts with dials, springs, inner liner helmet and solid rim outer shell attached to inner liner helmet.
01: Outer shell original shape piece part
02: Outer shell original shape piece part
03: Outer shell original shape piece part
04: Outer shell original shape piece part
05: Outer shell original shape piece part
06: Outer shell original shape piece part
07: Outer shell original shape piece part
08: Outer shell original shape piece part
09: Outer shell original shape piece part
10: Solid rim outer shell
FIG. 8: Left Side View: of inner liner helmet with bosses and stud guides attached to helmet
11: Outer shell ear hole
15: Inner liner helmet bosses
16: Stud guides (male)
17: Inner liner helmet solid shell
FIG. 9: Top View: of the inner liner helmet with bosses and stud guides attached to helmet
15: Inner liner helmet bosses
16: Stud guides
17: Inner liner helmet solid shell
FIG. 10: Right Side View: of the inner liner helmet with bosses and stud guides attached to helmet
15: Inner liner helmet bosses
16: Stud guides
17: Inner liner helmet solid shell
FIG. 11: Exploded View: of outer shell piece parts with dials, springs, inner liner helmet and solid rim outer shell attached to inner liner helmet.
01: Outer shell original shape piece part
02: Outer shell original shape piece part
03: Outer shell original shape piece part
04: Outer shell original shape piece part
05: Outer shell original shape piece part
06: Outer shell original shape piece part
07: Outer shell original shape piece part
08: Outer shell original shape piece part
09: Outer shell original shape piece part
10: Solid rim outer shell
24: Compression Springs
25: Dials
FIG. 12: Front View: of outer shell piece parts with dials, springs, inner liner helmet and solid rim outer shell attached to inner liner helmet.
01: Outer shell original shape piece part
02: Outer shell original shape piece part
03: Outer shell original shape piece part
04: Outer shell original shape piece part
05: Outer shell original shape piece part
06: Outer shell original shape piece part
07: Outer shell original shape piece part
08: Outer shell original shape piece part
10: Solid rim outer shell
17: Inner liner helmet solid shell
18: Outer shell original shape piece part (bosses)
19: Stud guide (female)
24: Compression Spring
25: Dial
26: Connecting support to inner and outer shell solid rim attached together
FIG. 13: Back Exploded View: view of outer shell piece parts with dials, springs, inner liner helmet and solid rim outer shell attached to inner liner helmet.
01: Outer shell original shape piece part
02: Outer shell original shape piece part
03: Outer shell original shape piece part
04: Outer shell original shape piece part
05: Outer shell original shape piece part
06: Outer shell original shape piece part
07: Outer shell original shape piece part
08: Outer shell original shape piece part
09: Outer shell original shape piece part
10: Solid rim outer shell
17: Inner liner helmet solid shell
18: Outer shell original shape piece part (bosses)
19: Stud guide (female)
24: Compression Spring
25: Dial
FIG. 14: Right Side Exploded View: of outer shell piece parts with dials, springs, inner liner helmet and solid rim outer shell attached to inner liner helmet.
01: Outer shell original shape piece part
02: Outer shell original shape piece part

Figure 15:
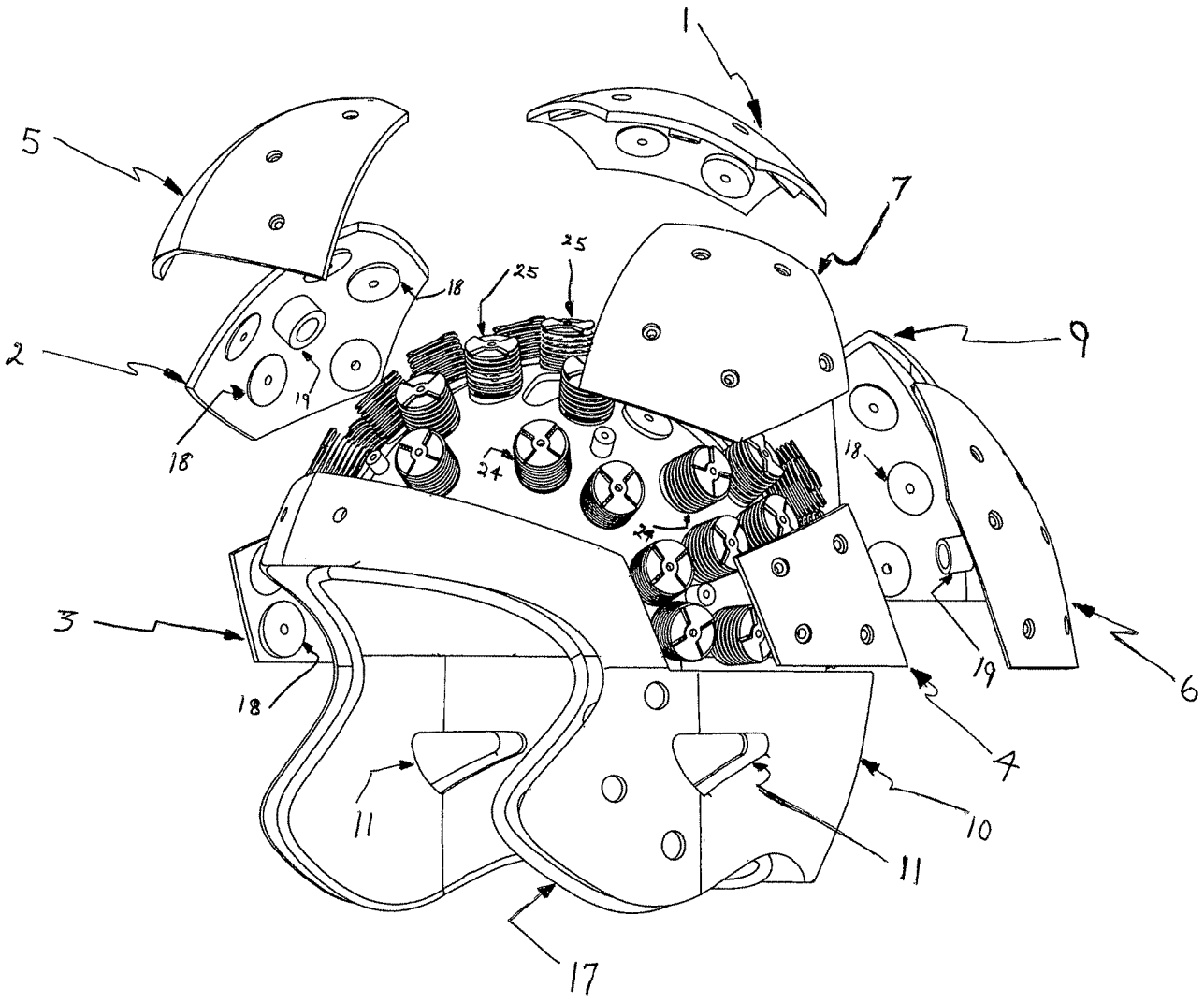
FIG. 15 Is a left side exploded view of outer shell piece parts with dials, springs, inner liner helmet and solid rim outer shell attached to inner liner helmet.
Figure 16:
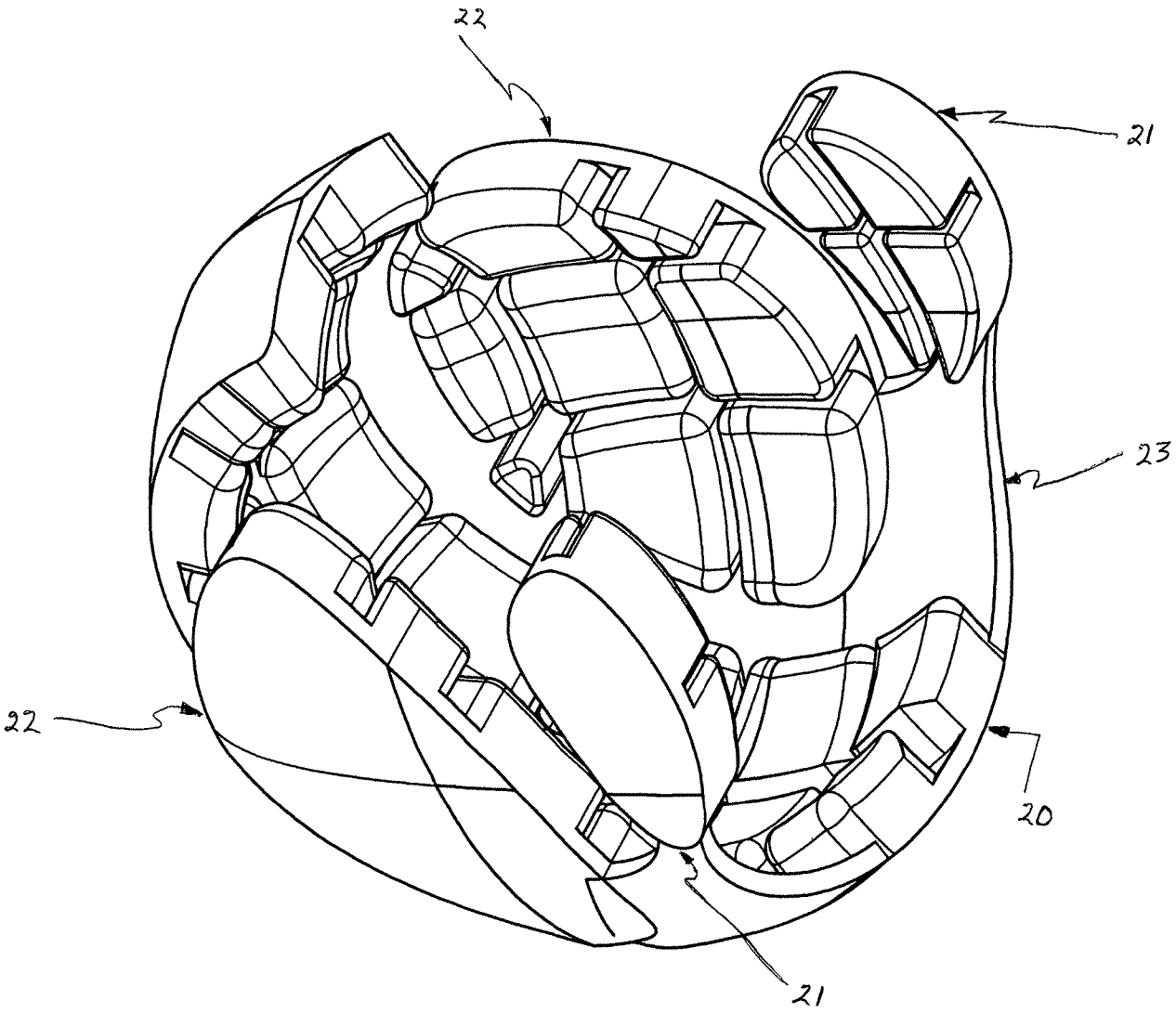
FIG. 16 Is a bottom exploded view of helmet pads.
Figure 17:
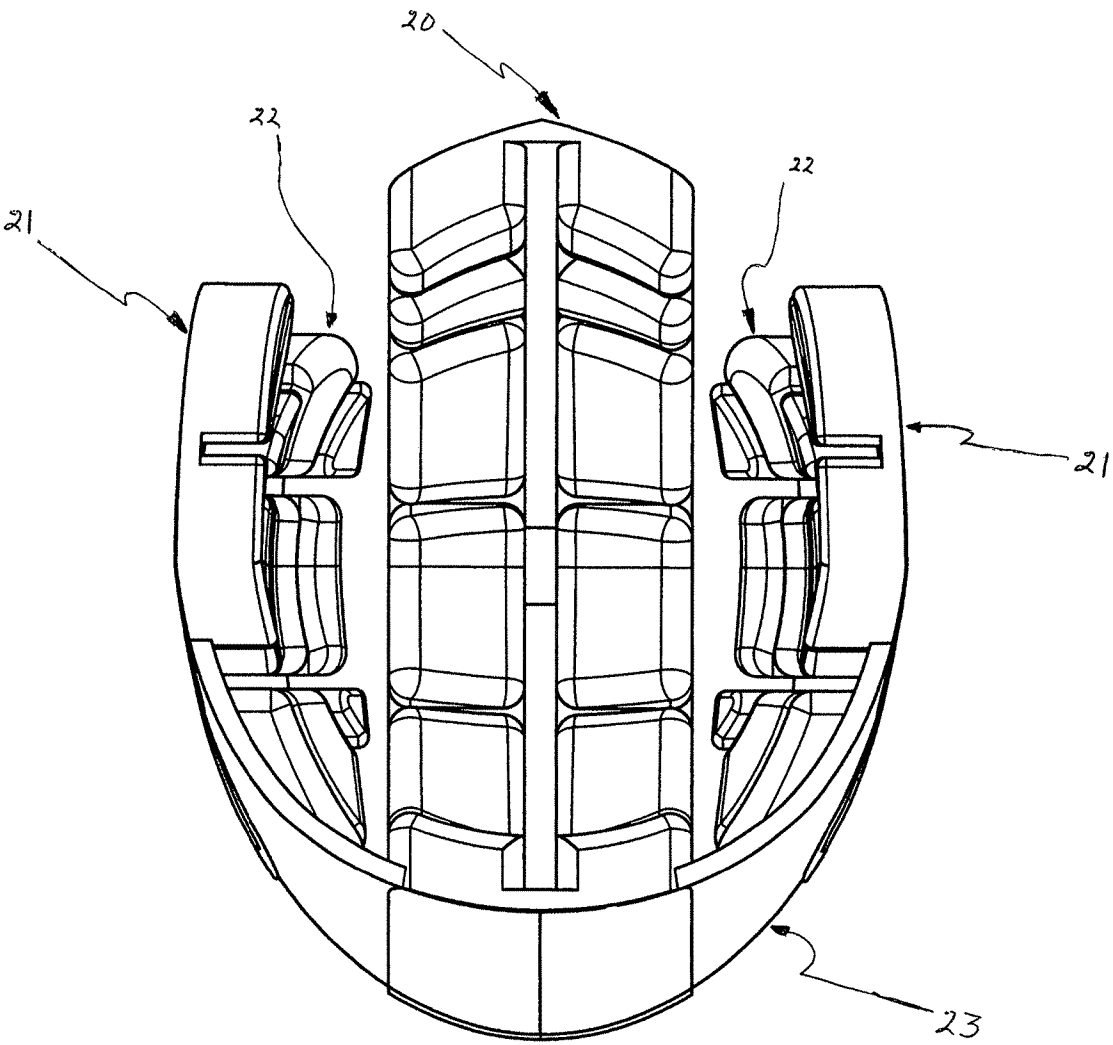
FIG. 17 Is a bottom view of helmet pads.
Figure 18:
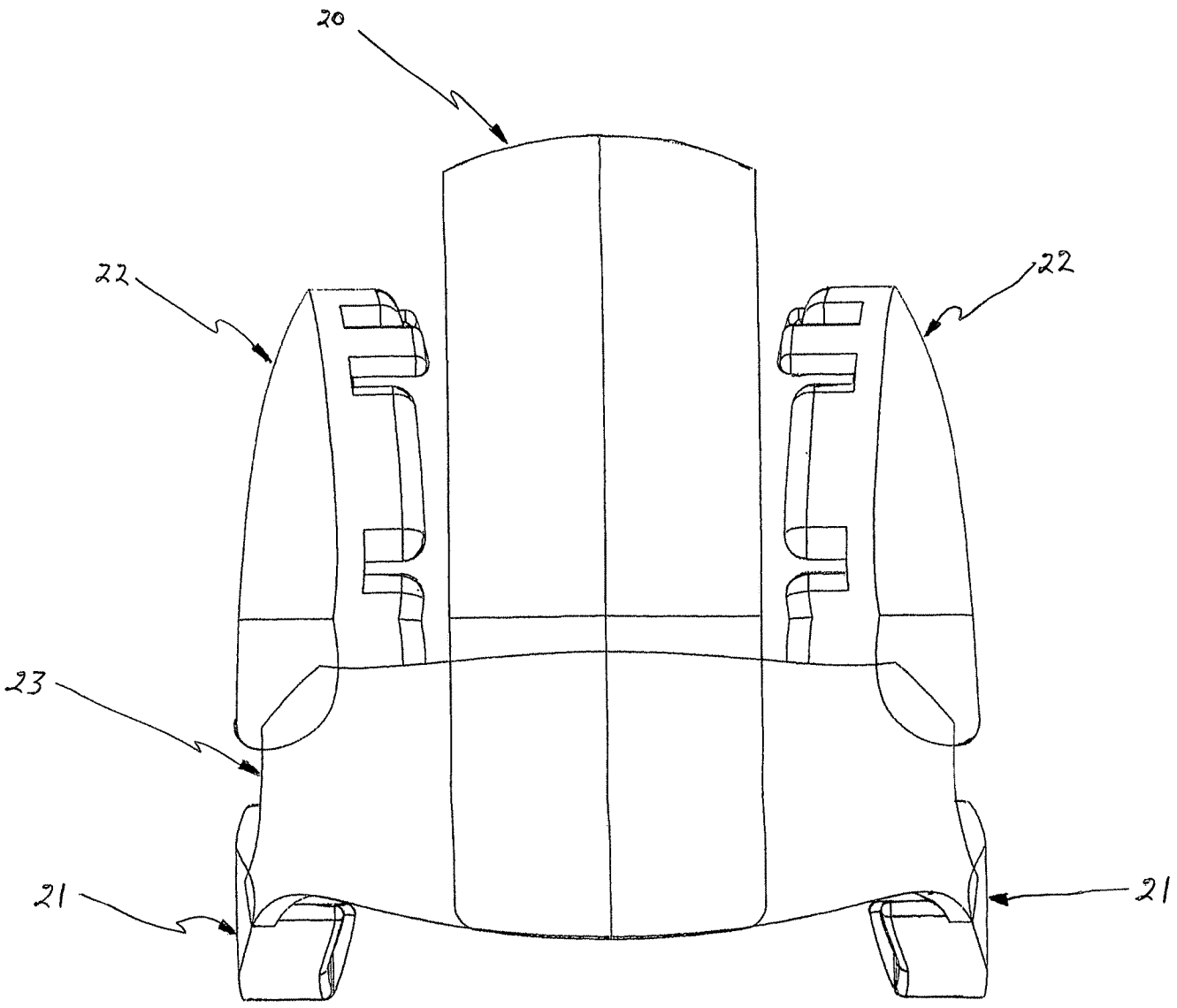
FIG. 18 Is a back view of helmet pads.
Figure 19:
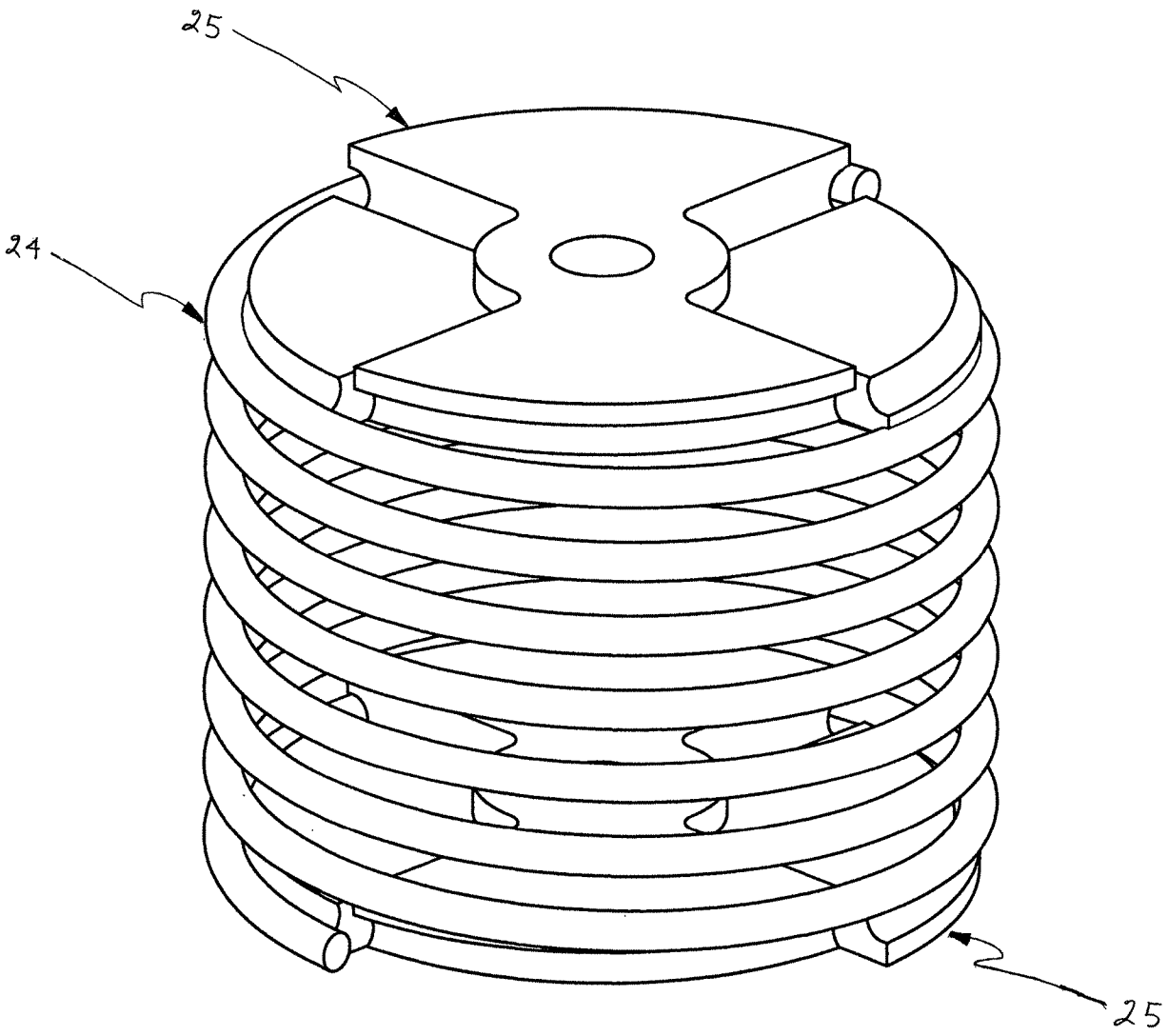
FIG. 19 Is a front view of dials and springs.
Figure 20:
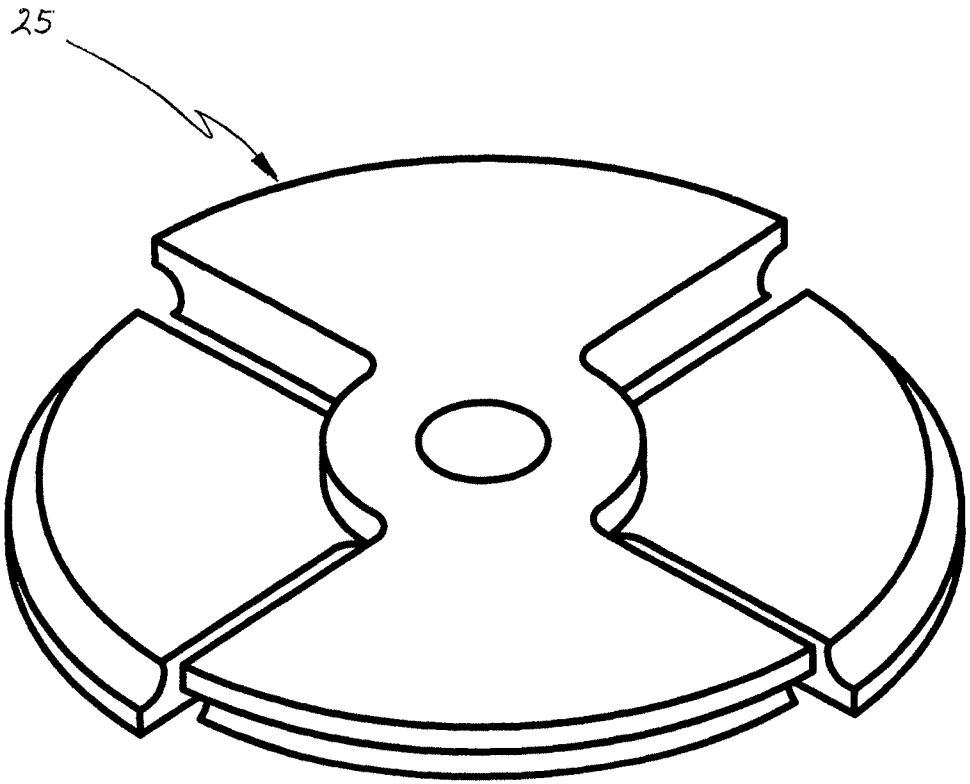
FIG. 20 Is a front view of dial.
Figure 21:
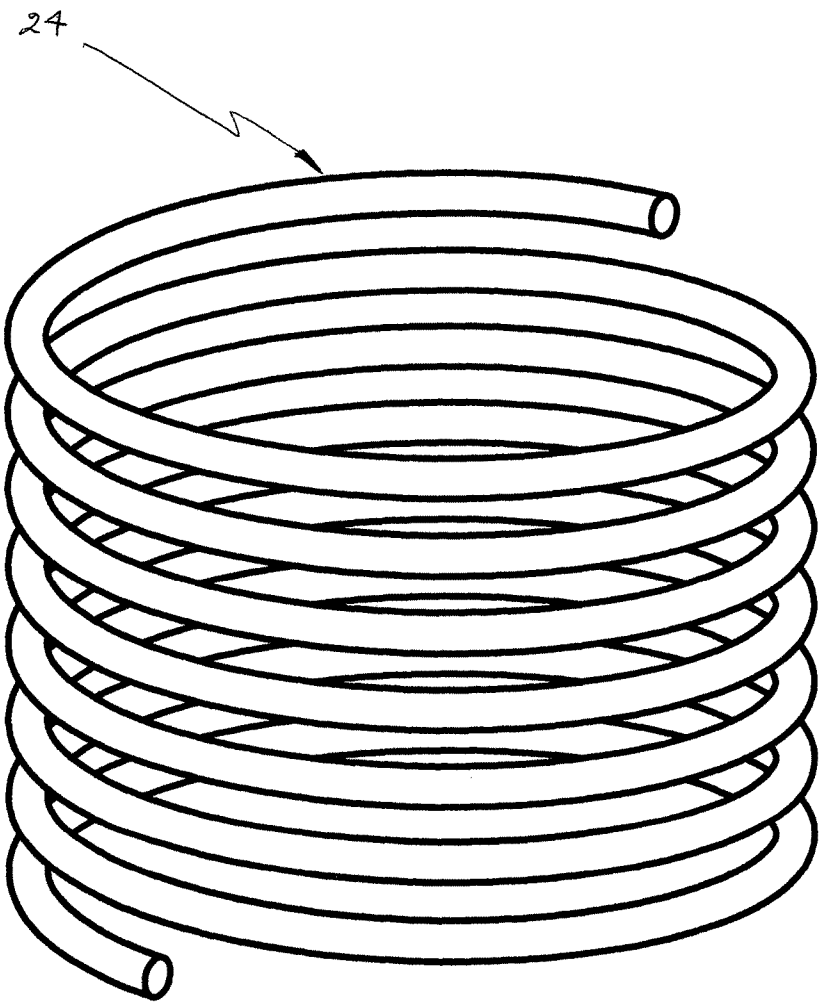
FIG. 21 Is a front view of spring.

03: Outer shell original shape piece part
04: Outer shell original shape piece part
05: Outer shell original shape piece part
07: Outer shell original shape piece part
08: Outer shell original shape piece part
09: Outer shell original shape piece part
10: Solid rim outer shell
11: Outer shell ear hole
17: Inner liner helmet solid shell
18: Outer shell original shape piece part (bosses)
19: Stud guide (female)
24: Compression Spring
25: Dial
26: Connecting support to inner and outer shell solid rim attached together FIG. 15: Left Side Exploded View: of outer shell piece parts with dials, springs, inner liner helmet and solid rim outer shell attached to inner liner helmet.
01: Outer shell original shape piece part
02: Outer shell original shape piece part
03: Outer shell original shape piece part
04: Outer shell original shape piece part
05: Outer shell original shape piece part
06: Outer shell original shape piece part
07: Outer shell original shape piece part
09: Outer shell original shape piece part
10: Outer shell ear hole
11: Outer shell ear hole
17: Inner liner helmet solid shell
18: Outer shell original shape piece part (bosses)
19 Stud guide (female)
24: Compression Spring
25: Dial
26: Connecting support to inner and outer shell solid rim attached together FIG. 16: Bottom Exploded View: of helmet pads
20: Inner liner helmet head pads
21: Inner liner helmet ear pads
22: Inner helmet left side and right side head pads
23: Inner helmet head pad connector FIG. 17: Bottom View: of helmet pads
20: Inner liner helmet head pads
21: Inner liner helmet ear pads
22: Inner helmet left side and right side head pads
23: Inner helmet head pad connector FIG. 18: Back View: of helmet pads
20: Inner liner helmet head pads
21: Inner liner helmet ear pads
22: Inner helmet left side and right side head pads
23: Inner helmet head pad connector FIG. 19: Front View: of dials and spring.
24: Compression Spring
25: Dial FIG. 20: Front View: view of dial.
25: Dial FIG. 21: Front View: view of spring
24: Compression Spring

DETAILED DESCRIPTION OF THE INVENTION

A protective football helmet is provided having a two-piece mold shell diminution shell system. The outer shell diminution is a piece parted to absorb the impact energy individually by the outer shell protection. Each outer shell piece parted section takes on the impact of energy with an oval shape to deflect and transfer contact impact energy from one piece part to another. Thereby dispersing the energy throughout the outer shell of the helmet.

The outer shell has a connected support system underneath each piece parted system supported by a shock absorber spring loaded pressure system which is connected to the inner shell.

The inner shell is a solid shell. It is the third level of protection that works as a three parted unit to protect the human head from direct blow to the head from helmet to helmet contact. This inner helmet is designed to take on the initial linear force separately from the outer shell. The inner shell also has on the outer rim a solid piece completely around the helmet that is connected to the inner shell to connect the inner shell and the outer shell to makeup one helmet unit. Underneath the inner shell is a unique designed padding system.

Note: some helmets have an outer solid piece around it and some don't. Also some have a solid rim and some don't.

The present invention comprises a helmet. The helmet comprising a multi-piece outer shell comprising a plurality of female stud guides; a solid rim outer shell; an inner liner comprising a solid shell wherein the inner liner further comprises a plurality of inner liner helmet bosses and male stud guides; said plurality of male and female stud guides configured to provide a removable connection between each piece of the outer shell and the inner liner; a plurality of compression springs configured as shocks wherein said each of said plurality of compression springs further comprise a spin dial configured to permit adjustment of the tension of each of said plurality of compression springs; a padding located within said inner liner configured to contact a user's head; and said plurality of compression springs located between the multi-piece outer shell and the inner liner.

The invention claimed is:

1. A helmet comprising:

a multi-piece outer shell comprising a plurality of female stud guides; a solid rim outer shell;

an inner liner comprising a solid shell wherein the inner liner further comprises a plurality of inner liner helmet bosses and male stud guides;

said plurality of male and female stud guides configured to provide a removable connection between each piece of the outer shell and the inner liner;

a plurality of compression springs configured as shocks wherein said each of said plurality of compression springs further comprise a spin dial configured to permit adjustment of the tension of each of said plurality of compression springs;

optionally further comprising conventional springs;

a padding located within said inner liner configured to contact a user's head; and said plurality of compression springs and said optional conventional springs located between the multi-piece outer shell and the inner liner.

* * * * *